US006017478A

United States Patent [19]

Kent et al.

[11] Patent Number: 6,017,478

[45] Date of Patent: Jan. 25, 2000

[54] METHOD OF MAKING HOLLOW BICOMPONENT FILAMENTS

[75] Inventors: Diane R. Kent; Matthew B. Hoyt, both of Arden; Charles F. Helms, Jr., Asheville, all of N.C.

[73] Assignee: BASF Corporation, Mt. Olive, N.J.

[21] Appl. No.: 09/164,755

[22] Filed: Oct. 1, 1998

Related U.S. Application Data

[62] Division of application No. 08/961,252, Oct. 30, 1997, Pat. No. 5,904,982

[60] Provisional application No. 60/034,748, Jan. 10, 1997.

[51] Int. Cl.[7] ..... D01D 5/24; D01D 5/34; D01F 8/12

[52] U.S. Cl. ..... 264/172.1; 264/172.12; 264/172.15; 264/172.18; 264/210.8; 264/211

[58] Field of Search ..... 264/172.1, 172.15, 264/172.18, 177.13, 177.2, 210.8, 211, 172.12

[56] References Cited

U.S. PATENT DOCUMENTS

| | | | |
|---|---|---|---|
| 3,095,258 | 6/1963 | Scott | 18/54 |
| 3,745,061 | 7/1973 | Champaneria et al. | 428/398 |
| 4,279,053 | 7/1981 | Payne et al. | 15/159 A |
| 4,303,733 | 12/1981 | Bülle et al. | 428/367 |
| 4,407,889 | 10/1983 | Gintis et al. | 428/398 |
| 4,648,830 | 3/1987 | Peterson et al. | 425/464 |
| 4,713,291 | 12/1987 | Sasaki et al. | 428/373 |
| 4,861,661 | 8/1989 | Samuelson | 428/398 |
| 5,208,107 | 5/1993 | Yeh et al. | 428/397 |
| 5,244,614 | 9/1993 | Hagen | 264/78 |
| 5,320,512 | 6/1994 | Moore, Sr. | 425/131.5 |
| 5,380,592 | 1/1995 | Tung | 429/397 |
| 5,445,884 | 8/1995 | Hoyt et al. | 428/370 |
| 5,458,972 | 10/1995 | Hagen | 428/373 |
| 5,462,802 | 10/1995 | Mikoshiba et al. | 428/376 |
| 5,464,676 | 11/1995 | Hoyt et al. | 428/85 |

FOREIGN PATENT DOCUMENTS

| | | |
|---|---|---|
| 705 923A1 | 4/1996 | European Pat. Off. . |
| WO 92/02669 | 2/1992 | WIPO . |

*Primary Examiner*—Leo B. Tentoni
*Attorney, Agent, or Firm*—Laura D. Nammo

[57] ABSTRACT

Novel bicomponent fibers have a sheath domain and an core domain which is embedded entirely within, and thereby completely surrounded by, the polyamide domain. The core domain is annular and defines a longitudinally extending central void. The preferred bicomponent fibers have a sheath-core structure wherein the polyamide domain constitutes the sheath and a fiber-forming polyolefin polymer constitutes the core. The preferred trilobal bicomponent fibers will exhibit a modification ratio of between 2 to 4, an arm angle of between 7° to about 35°, and a total cross-sectional void area between about 3 and about 10 percent. Each lobe of the fiber may optionally contain a lobal void space which, if present, is preferably radially elongate in cross-section.

12 Claims, 1 Drawing Sheet

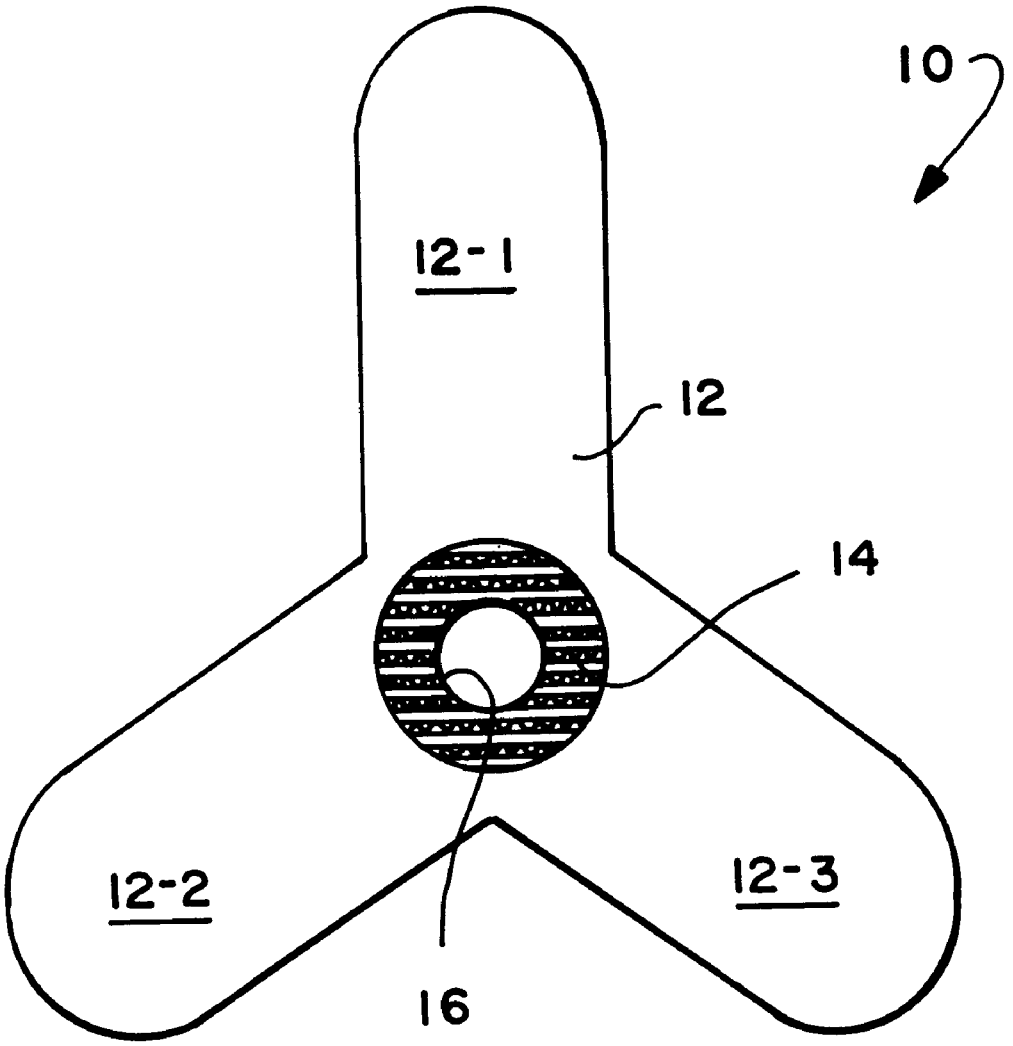
10
12-1
12
14
12-2
12-3
16

METHOD OF MAKING HOLLOW BICOMPONENT FILAMENTS

CROSS-REFERENCE TO RELATED APPLICATION

This application is a divisional application of copending U.S. patent application Ser. No. 08/961,252, filed Oct. 30, 1997, now U.S. Pat. No. 5,904,982, which claims priority of U.S. Provisional Patent Application Ser. No. 60/034,748, filed Jan. 10, 1997, now abandoned. This application is related to, and claims domestic priority benefits under 35 USC §119(e) from, U.S. Provisional Application Ser. No. 60/034,748 filed on Jan. 10, 1997, the entire content of which is expressly incorporated hereinto by reference.

FIELD OF INVENTION

The present invention relates generally to the field of synthetic fibers. More particularly, the present invention relates to synthetic bicomponent fibers having a sheath-core structure. In particularly preferred forms, the present invention is embodied in multi-lobal (e.g., trilobal) bicomponent fibers having a sheath domain entirely surrounding a longitudinally coextensive annular core domain which defines a longitudinally extending central void.

BACKGROUND AND SUMMARY OF THE INVENTION

Polyamide has been utilized extensively as a synthetic fiber. While its structural and mechanical properties make it attractive for use in such capacities as carpeting, it is nonetheless relatively expensive. It would therefore be desirable to replace a portion of polyamide fibers with a core formed from a relatively lower cost non-polyamide material. However, replacing a portion of a 100% polyamide fiber with a core portion of a relatively less expensive non-polyamide material may affect the mechanical properties of the fiber to an extent that it would no longer be useful in its intended end-use application (e.g., as a carpet fiber).

Furthermore, as evidenced by U.S. Pat. No. 5,208,107 (the entire content of which is expressly incorporated hereinto by reference), hollow trilobal fibers have been proposed in the past so as to provide desirable "cover" and soil hiding properties. In essence, these conventional hollow trilobal filaments are characterized by a total cross-section void area of between about 3 and about 10 percent and have a single approximately axially extending central void.

It would therefore be highly desirable if sheath-core bicomponent filaments could be provided so as to minimize expenses associated with the higher cost sheath component. At the same time it would be desirable if such bicomponent filaments were provided with longitudinally extending central voids so as to provide the cover, luster and soil hiding characteristics associated conventional hollow trilobal filaments. It is towards fulfilling such needs that the present invention is directed.

BRIEF DESCRIPTION OF THE DRAWINGS

Reference will hereinafter be made to the accompanying drawing FIGURE which is a schematic cross-sectional view of a representative hollow trilobal sheath-core bicomponent filament in accordance with the present invention.

DETAILED DESCRIPTION OF THE PREFERRED EXEMPLARY EMBODIMENTS

As used herein and in the accompanying claims, the term "fiber" includes fibers of extreme or indefinite length (filaments) and fibers of short length (staple). The term "yarn" refers to a continuous strand or bundle of fibers.

The term "fiber-forming" is meant to refer to at least partly oriented, partly crystalline, linear polymers which are capable of being formed into a fiber structure having a length at least 100 times its width and capable of being drawn without breakage at least about 10%.

The term "bicomponent fiber" is a fiber having at least two distinct cross-sectional domains respectively formed of different polymers. The term "bicomponent fiber" is thus intended to include concentric and eccentric sheath-core fiber structures, symmetric and asymmetric side-by-side fiber structures, island-in-sea fiber structures and pie wedge fiber structures. Preferred according to the present invention are concentric bicomponent sheath-core fiber structures having a polyamide sheath and a non-polyamide (e.g., polyolefin) core having the structures shown, for example, in U.S. Pat. No. 5,244,614 (the entire content of which is expressly incorporated hereinto by reference). However, the present invention is equally applicable to other bicomponent fiber structures having other distinct longitudinally coextensive polymeric domains.

The term "linear polymer" is meant to encompass polymers having a straight chain structure wherein less than about 10% of the structural units have side chains and/or branches.

The term "annular" is meant to refer to a cross-sectional polymer domain geometry in a bicomponent fiber which entirely surrounds, bounds or defines one or more voids. The term "annular" thus embraces circular or non-circular ring-shaped cross-sectional polymer domains which define at least one longitudinally extending void in the bicomponent fiber. The "annular" polymer domain may have concentric inner and outer boundaries or may be eccentric in that the geometrical shape of the inner boundary which defines a longitudinally extending void may be different from the outer boundary.

The preferred polyamides useful to form the sheath of the bicomponent fibers of this invention are those which are generically known by the term "nylon" and are long chain synthetic polymers containing amide (—CO—NH—) linkages along the main polymer chain. Suitable melt spinnable, fiber-forming polyamides for the sheath of the sheath-core bicomponent fibers according to this invention include those which are obtained by the polymerization of a lactam or an amino acid, or those polymers formed by the condensation of a diamine and a dicarboxylic acid. Typical polyamides useful in the present invention include nylon 6, nylon 6/6, nylon 6/9, nylon 6/10, nylon 6T, nylon 6/12, nylon 11, nylon 12 and copolymers thereof or mixtures thereof. Polyamides can also be copolymers or nylon 6 or nylon 6/6 and nylon salt obtained by reacting a dicarboxylic acid component such as terephthalic acid, isophthalic acid, adipic acid or sebacic acid with a diamine such as hexamethylene diamine, methaxylene diamine, or 1,4-bisamino-methylcyclohexane. Preferred are poly-ε-caprolactam (nylon 6) and polyhexamethylene adipamide (nylon 6/6). Most preferred is nylon 6.

As noted briefly above, the filaments according to this invention will most preferably include a longitudinally coextensive fiber-forming polyolefin core domain which is entirely surrounded by the sheath domain. Linear polypropylene and polyethylene are particularly preferred in this regard.

The core will represent less than about 30% by weight of the fibers according to this invention, with the sheath representing greater than about 70 wt. %. More preferably, the core will be less than about 25 wt. % of the fibers according to this invention, with the sheath being present in the fibers in an amount greater than about 75 wt. %. Thus, weight ratios of the sheath to the core in the fibers of this invention may range from about 2.3:1 to about 10:1, with a ratio of greater than about 3:1 being particularly preferred. Yams formed from fibers according to this invention will exhibit desirable properties, such as less than about 75% heat-set shrinkage as compared to yarns formed of 100% polyamide fibers.

The core may also be formed of an amorphous linear polymer which in and of itself is non-fiber-forming. Suitable amorphous polymers for use in the practice of this invention include polystyrene, polyisobutene and poly(methyl methacrylate). Preferably, the core is formed of amorphous polystyrene, with amorphous atactic polystyrene being particularly preferred.

The core may optionally include an inert particulate filler material dispersed therein. The filler material must have an average particle size which is sufficiently small to pass through the polymer filter of the spinneret without affecting filter pressure. In this regard, particulate filler materials having a particle size in the range between about 0.1 to 5.0 $\mu$m, and preferably less than about 2.5 $\mu$m may be employed. When used, the filler material may be blended in a melt of the polyolefin core resin prior to being co-melt-spun with the polyamide sheath resin using conventional melt-blending equipment. Thus, for example, the filler material may be introduced via a side-arm associated with an extruder which melts the polyolefin and blends the introduced filler material therein upstream of the spinneret pack.

Suitable particulate filler materials include calcium carbonate, alumina trihydrate, barium sulfate, calcium sulfate, mica, carbon black, graphite, kaolin, silica, talc and titanium dioxide. Calcium carbonate is particularly preferred.

The sheath-core fibers are spun using conventional fiber-forming equipment. Thus, for example, separate melt flows of the sheath and core polymers may be fed to a conventional sheath-core spinneret pack such as those described in U.S. Pat. Nos. 5,162,074, 5,125,818, 5,344,297 and 5,445,884 (the entire content of each patent being incorporated expressly hereinto by reference) where the melt flows are combined to form extruded multi-lobal (e.g., tri-, tetra-, penta- or hexalobal) fibers having sheath and core structures. Preferably, the fibers have a tri-lobal structure with a modification ratio of at least about 1.4, more preferably between 2 and 4. In this regard, the term "modification ratio" means the ratio $R_1/R_2$, where $R_2$ is the radius of the largest circle that is wholly within a transverse cross-section of the fiber, and $R_1$ is the radius of the circle that circumscribes the transverse cross-section.

Hollow trilobal bicomponent filaments in accordance with this invention will most preferably have an arm angle (i.e., the angle formed by extension of the sides of the individual lobes, or arms) of between about 7° to about 35°, more preferably between about 10° to about 35°. In addition, the filaments will most preferably include a single central void which will represent about 3 to about 10 percent, more preferably between about 5 to about 8 percent, of the total fiber volume measured including the volume of the void. Although a central symmetrical void is presently preferred, the filaments according to this invention may also include voids positioned in each of the filament lobes. If present, such lobe voids most preferably are radially elongate (e.g., generally elliptical) in cross-section.

The extruded fibers are quenched, for example with air, in order to solidify the fibers. The fibers may then be treated with a finish comprising a lubricating oil or mixture of oils and antistatic agents. The thus formed fibers are then combined to form a yarn bundle which is then wound on a suitable package.

In a subsequent step, the yam is drawn and texturized to form a bulked continuous fiber (BCF) yarn suitable for tufting into carpets. A more preferred technique involves combining the extruded or as-spun fibers into a yarn, then drawing, texturizing and winding into a package all in a single step. This one-step method of making BCF is generally known in the art as spin-draw-texturing (SDT).

Nylon fibers for the purpose of carpet manufacturing have linear densities in the range of about 3 to about 75 denier/filament (dpf) (denier=weight in grams of a single fiber with a length of 9000 meters). A more preferred range for carpet fibers is from about 15 to 28 dpf.

The BCF yarns can go through various processing steps well known to those skilled in the art. For example, to produce carpets for floor covering applications, the BCF yams are generally tufted into a pliable primary backing. Primary backing materials are generally selected form woven jute, woven polypropylene, cellulosic nonwovens, and nonwovens of nylon, polyester and polypropylene. The primary backing is then coated with a suitable latex material such as a conventional styrene-butadiene (SB) latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene. Preferably, carpets for floor covering applications will include a woven polypropylene primary backing, a conventional SB latex formulation, and either a woven jute or woven polypropylene secondary carpet backing. The SB latex can include calcium carbonate filler and/or one or more the hydrate materials listed above.

While the discussion above has emphasized the fibers of this invention being formed into bulk continuous fibers for purposes of making carpet fibers, the fibers of this invention can be processed to form fibers for a variety of textile applications. In this regard, the fibers can be crimped or otherwise texturized and then chopped to form random lengths of staple fibers having individual fiber lengths varying from about 1½ to about 8 inches.

The fibers of this invention can be dyed or colored utilizing conventional fiber-coloring techniques. For example, the fibers of this invention may be subjected to an acid dye bath to achieve desired fiber coloration. Alternatively, the nylon sheath may be colored in the melt prior to fiber-formation (i.e., solution dyed) using conventional pigments for such purpose.

A further understanding of this invention will be obtained from the following non-limiting Example which illustrates a specific embodiments thereof.

EXAMPLE

Nylon 6 (BASF Corporation Ultramid® BS-700F nylon) and polypropylene (Solvay Polymers Fortilene® 3808 polypropylene) are melt-extruded through spinneret orifices as disclosed U.S. Pat. No. 5,208,107 using the techniques described more fully in U.S. Pat. No. 5,244,614 (incorporated fully hereinto by reference). The respective polymers are filtered and delivered to a pair of plates such as described in U.S. Pat. No. 2,989,789 (incorporated fully hereinto by reference) except that there is no spinneret capillary below the chamber where the materials are combined. Instead, this is done above a thin plate and a spinneret backhole such that the sheath-core polymer flows are delivered to the spinneret backholes. The polymer flows are delivered to the backholes of the spinneret such that 75% by weight of nylon 6 is present in the sheath and 25% by weight polypropylene is in the core.

Fifty-eight (58) filaments are formed with each filament being cooled, drawn and textured in a continuous spin-draw apparatus (Rieter J0/0). The draw ratio is 2.8 and the winding speed is 2200 meters per minute. The resulting filament cross-section is depicted in the accompanying FIGURE. As is seen, the filament 10 is composed of a sheath domain 12 having three substantially equidistantly spaced-apart lobes 12-1, 12-2 and 12-3. The sheath domain 12 entirely surrounds a concentrically positioned, longitudinally coextensive annular core domain 14. The annular core domain 14 itself entirely surrounds and defines a longitudinally coextensive central void 16.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of making a hollow, multilobal bicomponent fiber comprising a core domain and a polyamide sheath domain, wherein said method comprises directing respective melt flows of sheath and core polymers to a spinneret, forming a bicomponent fiber by extruding the sheath and core polymers through orifices of the spinneret to form a fiber having respective longitudinally coextensive sheath and core polymer domains corresponding to said sheath and core polymers, and simultaneously with said extruding of the sheath and core polymers, forming a longitudinally extending central void which is entirely surrounded by said core domain.

2. The method of claim 1, further comprising drawing the fiber by at least about 10%.

3. The method of claim 1, wherein the polyamide sheath domain is a nylon selected from the group consisting of nylon 6, nylon 6/6, nylon 6/9, nylon 6/10, nylon 6T, nylon 6/12, nylon 11, nylon 12, nylon 4,6 and copolymers thereof and mixtures thereof.

4. The method of claim 1, wherein the core domain is a fiber-forming polyolefin.

5. The method of claim 4, wherein the polyolefin core domain is a linear polypropylene or polyethylene.

6. The method of claim 4, wherein the polyolefin domain includes a particulate filler material dispersed therein.

7. The method of claim 6, wherein the filler material is calcium carbonate.

8. The method of claim 1, wherein the fiber has an arm angle of between about 7° to about 35°.

9. The method of claim 8, wherein the cross-sectional void area of said central void is between about 3 and about 10 percent.

10. The method of claim 9, wherein the fiber has a modification ratio of between about 2 and 4.

11. A method of making a hollow, bicomponent fiber comprising a core domain and a multilobal, polyamide sheath domain, wherein at least one lobe of said sheath domain includes a lobal void space, said method comprising directing respective melt flows of sheath and core polymers to a spinneret, forming a bicomponent fiber by extruding the sheath and core rolymers through orifices of the spinneret to form a fiber having respective longitudinally coextensive sheath and core polymer domains corresponding to said sheath and core polymers, and simultaneously with said extruding of the sheath and core polymers, forming a longitudinally extending central void which is entirely surrounded by said core domain.

12. The method of claim 11, wherein the lobal void space is radially elongate in cross-section.

* * * * *